US009888327B2

(12) United States Patent
Nikles et al.

(10) Patent No.: US 9,888,327 B2
(45) Date of Patent: Feb. 6, 2018

(54) HEARING AID DEVICE HAVING A FOLDED DIPOLE

(71) Applicant: SIVANTOS PTE. LTD., Singapore (SG)

(72) Inventors: Peter Nikles, Erlangen (DE); Thomas Fischer, Erlangen (DE); Jan Bauer, Fuerth (DE); Mario Schuehler, Marloffstein (DE); Hans Adel, Stein (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/737,771

(22) Filed: Jun. 12, 2015

(65) Prior Publication Data

US 2015/0296312 A1 Oct. 15, 2015

Related U.S. Application Data

(63) Continuation of application No. PCT/EP2013/063027, filed on Jun. 21, 2013.

(30) Foreign Application Priority Data

Dec. 12, 2012 (DE) ..... 10 2012 222 883

(51) Int. Cl.
*H04R 3/00* (2006.01)
*H04R 25/00* (2006.01)
(Continued)

(52) U.S. Cl.
CPC ..... *H04R 25/556* (2013.01); *H01Q 1/273* (2013.01); *H01Q 9/26* (2013.01); *H04R 25/554* (2013.01);
(Continued)

(58) Field of Classification Search
CPC ..... H01Q 1/273; H04R 2225/33; H04R 2225/51; H04R 25/554; H04R 25/558;
(Continued)

(56) References Cited

U.S. PATENT DOCUMENTS 7,450,078 B2 11/2008 Knudsen et al.
7,593,538 B2 9/2009 Polinske
(Continued)

FOREIGN PATENT DOCUMENTS

EP 1788663 A1 * 5/2007 ..... H01Q 7/00
EP 2285138 A1 * 2/2011 ..... H01Q 1/273
EP 2458675 A2 5/2012

*Primary Examiner* — MD S Elahee
*Assistant Examiner* — Julie X Dang
(74) *Attorney, Agent, or Firm* — Laurence A. Greenberg; Werner H. Stemer; Ralph E. Locher

(57) ABSTRACT

A hearing aid device has an antenna device. The antenna device is configured to receive and/or transmit electromagnetic waves of a predetermined wavelength lambda. The antenna device has an energy coupling device which is configured to supply or to draw electrical energy to or from the antenna device. The antenna device has a first conductor and a second conductor, which are in energy exchange with the energy coupling device, extend away from the energy coupling device in different directions and are arranged a short distance from a third conductor. A first ohmic connection between the first conductor and the third conductor and a second ohmic connection between the second conductor and the third conductor are arranged at a predefined distance from the energy coupling device.

20 Claims, 2 Drawing Sheets

(51) Int. Cl.
*H01Q 1/27* (2006.01)
*H01Q 9/26* (2006.01)

(52) U.S. Cl.
CPC ..... *H04R 2225/33* (2013.01); *H04R 2225/51* (2013.01)

(58) Field of Classification Search
CPC ..... H04R 25/60; H04R 2225/021; H04R 25/552; H04R 25/556; H04R 25/65; H04R 25/55; H04R 25/602; H04R 25/658; H04R 25/70
USPC ..... 381/315, 318; 343/717, 702, 895, 718, 343/866
See application file for complete search history.

(56) References Cited

U.S. PATENT DOCUMENTS 7,605,764 B2 10/2009 Ishimiya
8,675,902 B2 3/2014 Christensen et al.
2006/0220971 A1* 10/2006 Sato ..... G04G 21/04 343/718
2007/0080889 A1* 4/2007 Zhang ..... H01Q 1/273 343/895
2008/0280654 A1* 11/2008 Solomon ..... H04M 1/6066 455/569.1
2009/0196449 A1* 8/2009 Platz ..... H01Q 1/085 381/330
2010/0085268 A1* 4/2010 Yeh ..... H01Q 7/00 343/803
2010/0171676 A1* 7/2010 Tani ..... H01Q 1/243 343/803
2011/0009925 A1* 1/2011 Leigh ..... A61N 1/36032 607/60
2012/0093324 A1* 4/2012 Sinasi ..... H01Q 1/273 381/23.1
2013/0017786 A1 1/2013 Kvist et al.
2013/0308805 A1 11/2013 Özden

* cited by examiner

HEARING AID DEVICE HAVING A FOLDED DIPOLE

CROSS-REFERENCE TO RELATED APPLICATION

This is a continuation application, under 35 U.S.C. § 120, of copending international application No. PCT/EP2013/063027, filed Jun. 21, 2013, which designated the United States; this application also claims the priority, under 35 U.S.C. § 119, of German patent application No. DE 10 2012 222 883.7, filed Dec. 12, 2012; the prior applications are herewith incorporated by reference in their entireties.

BACKGROUND OF THE INVENTION

Field of the Invention

The invention relates to a hearing aid device having an antenna device. The antenna device is configured to receive and/or emit electromagnetic waves of a predetermined wavelength lambda. The antenna device has an energy coupling device which is configured to supply electrical energy to the antenna device or to draw electrical energy from the antenna device.

Hearing aid devices are portable hearing apparatuses which are used to support those with impaired hearing. In order to satisfy the numerous individual requirements, different forms of hearing aid devices are provided, such as behind-the-ear hearing aids (BTE), hearing aids with an external receiver (RIC: receiver in the canal) and in-the-ear hearing aids, for example also concha hearing aids or canal hearing aids (ITE, CIC). The examples of hearing aids quoted are worn on the outer ear or in the auditory canal. Furthermore, however, bone conduction hearing aids, implantable or vibrotactile hearing aids are also commercially available. In this case, the damaged hearing is stimulated either mechanically or electrically.

In principle, the major components of hearing aids are an input transducer, an amplifier and an output transducer. The input transducer is generally an acousto-electric transducer, for example a microphone, and/or an electromagnetic receiver, for example an induction coil. The output transducer is generally in the form of an electroacoustic transducer, for example a miniature loudspeaker, or an electromechanical transducer, for example a bone conduction earpiece. The amplifier is normally integrated in a signal processing device.

In the past, hearing aid devices were often considered as individual systems which reproduce acoustic signals recorded by microphones in an accordingly modified and amplified manner. Magnetoinductive radio systems have combined these individual systems to form an overall system which, in addition to binaural coupling of the hearing aid devices, also allows wireless connection to external components such as mobile devices, multimedia units or programming devices. However, this connection functions only via an intermediate or relay station which converts the 2.4 GHz far-field connection of the external devices to the magnetoinductive near-field systems via Bluetooth. In this case, the relay station must always be in the vicinity of the person wearing the hearing aid device because the range of the magnetic system is highly limited in the near field.

Direct connection in the 2.4 GHz far field was limited for a long time by power consumption and the size of such systems. However, in the meantime, modern chip systems have a power consumption which allows use in the hearing aid device. However, the sensitivity of the chip systems still imposes high demands on the antenna design.

On account of the free space wavelength lambda of more than 10 cm in this range and the electrically small volume of the hearing aid device, a standard antenna design cannot be readily used. Antennas in hearing aid devices are therefore individual, non-modular solutions which must be specifically adapted to the hearing aid device.

U.S. Pat. No. 7,593,538 B2 describes an antenna which forms a single-layer or multilayer loop antenna by use of a flexible PCB and is connected to the main printed circuit board of the hearing aid.

U.S. Pat. No. 7,450,078 B2 likewise describes a loop antenna which is implemented by a single-layer conductor loop in the hearing aid.

Published, European patent application EP 2458675 A2, corresponding to U.S. patent publication Nos. 2012/0093324, 2013/0017786 and 2013/0308805, presents an antenna which uses the side surfaces of the hearing aid, by use of flexible printed circuit boards (PCB), to implement symmetrical or asymmetrical antenna structures. In principle, both side surfaces are considered independently of one another and are electrically connected to one another only by the antenna supply on the main printed circuit board.

Loop antennas have a large loop area with a space requirement in the housing and must therefore be newly configured for each new hearing aid. In addition, these antennas are greatly influenced by nearby metal objects or the head, which gives rise to both detuning of the antenna and increased losses at 2.4 GHz.

Antennas having parasitic elements also have a large area requirement and therefore cannot be flexibly integrated in a housing.

SUMMARY OF THE INVENTION

It is accordingly an object of the invention to provide a hearing aid device having a folded dipole that overcomes the above-mentioned disadvantages of the prior art devices of this general type, which antenna device allows for more flexible use in the hearing aid device.

The hearing aid device according to the invention relates to a hearing aid device having an antenna device, the antenna device being configured to receive and/or emit electromagnetic waves of a predetermined wavelength lambda. The antenna device has an energy coupling device which is configured to supply electrical energy to the antenna device or to draw electrical energy from the antenna device. The antenna device also has a first conductor and a second conductor which exchange energy with the energy coupling device. The first and second conductors extend away from the energy coupling device in different directions and are arranged at a short distance from a third conductor. A first ohmic connection is arranged between the first conductor and the third conductor and a second ohmic connection is arranged between the second conductor and the third conductor at a predetermined distance from the energy coupling device. In this case, the distance should be understood as meaning the length of a path between the energy coupling device and the ohmic connection along the first or second and/or third conductor.

The antenna device forms a folded dipole which establishes a closed electrical connection from the energy coupling device, via the first conductor, the first ohmic connection, the third conductor, the second ohmic connection and the second conductor, to the energy coupling device. The first and third conductors or second and third conductors initially extend away from the energy coupling device in different directions. In one possible embodiment, a part of the first conductor and a part of the second conductor also run substantially parallel to one another again in the further course. The folded dipole according to the invention differs from a loop antenna by the small enclosed area, which is why the folded dipole advantageously has a smaller space requirement and can be more easily accommodated in the hearing aid device. In comparison with a monopole or dipole, the folded dipole has a considerably higher base impedance at the energy coupling device. It is therefore possible to counteract the base resistance of the antenna which is very low anyway and results from the vicinity to the head. In addition, the ratio of radiation power and power loss and therefore the radiation efficiency of the antenna increase with the active component at the base.

In one embodiment, the short distance between the first conductor and the third conductor and between the second conductor and the third conductor is shorter than 0.05 times lambda.

As a result of the short distance, the space requirement of the antenna apparatus is advantageously particularly small and the base resistance increases as a result of the value which is small in comparison with the wavelength and the small enclosed area, which advantageously increases the active component at the base and therefore improves the ratio of radiation power and power loss and the radiation efficiency of the antenna.

In one embodiment, the predetermined distance between the ohmic connection and the energy coupling device has a length in the range between lambda divided by two and lambda divided by eight. In this case, the distance preferably has a length of substantially lambda divided by four.

For an extended folded dipole in free space, the radiation efficiency is ideal in the case of a length of the free arms from a base with the energy coupling device of lambda divided by four, that is to say a quarter of the wavelength of the wavelength to be emitted or the receiving wavelength. These distances may differ from the ideal value as a result of the influences of the environment and the geometry in which the antenna device is arranged in a manner deviating from a plane. In particular, the arrangement and the distances between the conductors as well as the carrier material influence the propagation speed and therefore the effective length of the electromagnetic wave, with the result that an effective length of lambda divided by four may differ considerably from a corresponding value for a free wave in space. In the case of an antenna device according to the invention, this distance is predetermined by the geometry and an ohmic connection is arranged at this distance. The ohmic connection can be given by a bend at which the first or second conductor merges into the third conductor or simply by a conductive connection between the first and third conductors or the second and third conductors. In the latter case, an antenna device can also be advantageously subsequently adapted or matched to different housing forms by applying the conductive connection only subsequently, for example by a solder point. An antenna can thus be advantageously used for different hearing aid devices under optimum conditions.

In one possible embodiment of the hearing aid device according to the invention, the antenna device has a fourth conductor. The fourth conductor is arranged at a short distance from the first conductor and the second conductor and/or the third conductor. As already stated, a distance of 0.05 times the wavelength lambda can be considered to be a short distance in the sense of the invention. As already explained above with respect to the third conductor, an ohmic connection is arranged between the first conductor and the fourth conductor and between the second conductor and the fourth conductor at the predetermined distance from the energy coupling device.

An additional, fourth conductor advantageously makes it possible to change the electromagnetic properties of the antenna device by a further parameter without increasing the predetermined distance, for example, and therefore to adapt the antenna device to the hearing aid device under predefined conditions.

In one embodiment of the hearing aid device according to the invention, the antenna device has a plane of symmetry which runs through the energy coupling device. In this case, it is conceivable, in particular, for the plane of symmetry of the antenna device to be oriented substantially parallel to a plane of symmetry of a head of a person wearing the hearing aid device when the hearing aid device is worn according to the use.

Such symmetry with respect to the head of a person wearing the hearing aid device advantageously allows a hearing aid device to be used on both sides of the head without the properties of the antenna device changing as a result of the influence of the head. The antenna device according to the invention therefore makes it possible to use a hearing aid device for both sides of the head.

In one embodiment, the hearing aid device has a structural element, the antenna device being part of the structural element. In this case, a hearing aid device housing but also a frame construction which carries various elements of the hearing aid device and arranges and fixes them inside the housing of the hearing aid device can be considered to be a structural element in the sense of the invention.

In the case of a hearing aid device according to the invention, the first, second and third and/or fourth conductors of the antenna device may therefore be arranged on the structural element or else may be integral parts.

As a result, the antenna device is advantageously fixed in its position with respect to components of the hearing aid device and is protected, with the result that defined and constant electromagnetic properties of the hearing aid device are ensured.

In one conceivable embodiment of the hearing aid device according to the invention, the first, second and third conductors are formed by structuring a conductive surface on the structural element.

The practice of structuring a conductive surface advantageously allows a great degree of freedom during shaping and also allows individual shaping during manufacture, for example by using a laser for structuring.

In one embodiment of the hearing aid device according to the invention, the antenna device is arranged on a flexible carrier element.

A flexible carrier element advantageously facilitates the process of introducing an antenna device into the housing of the hearing aid device and facilitates optimum use of the space. In addition, an antenna device on a flexible carrier element makes it possible to easily replace the antenna device.

In one possible embodiment, the energy coupling device is coupled to the antenna device using electrical coupling.

Electrical or ohmic coupling is advantageously space-saving and can be carried out without additional components.

In one conceivable embodiment, the energy coupling device is coupled capacitively to the antenna device.

Capacitive coupling advantageously enables coupling without direct mechanical contact. This enables simpler installation.

In one possible embodiment, the energy coupling device is coupled inductively to the antenna device.

Inductive coupling easily enables transformation and therefore adaptation to different impedances by a different selection of the inductance.

Other features which are considered as characteristic for the invention are set forth in the appended claims.

Although the invention is illustrated and described herein as embodied in a hearing aid device having a folded dipole, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
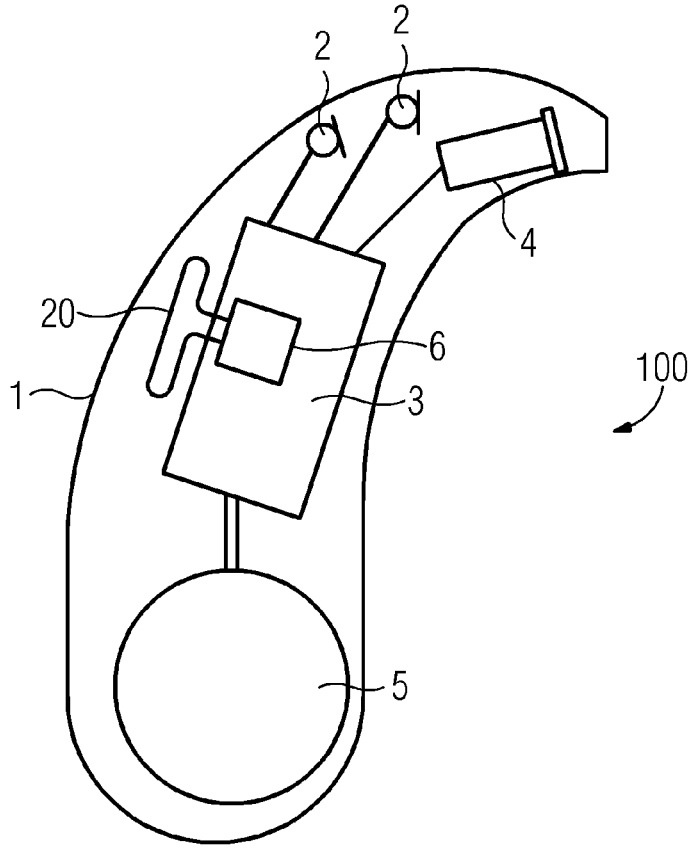
FIG. 1 is a schematic illustration of a hearing aid device according to the invention.

Referring now to the figures of the drawings in detail and first, particularly to FIG. 1 thereof, there is shown a basic structure of a hearing aid device 100 according to the invention. One or more microphones 2 for recording sound or acoustic signals from the environment are installed in a hearing aid housing 1 to be worn behind the ear. The microphones 2 are acousto-electric transducers 2 for converting sound into first audio signals. A signal processing device 3 which is likewise integrated in the hearing aid housing 1 processes the first audio signals. The output signal from the signal processing device 3 is transmitted to a loudspeaker or receiver 4 which outputs an acoustic signal. Sound is possibly transmitted to the eardrum of the person wearing the device via a sound tube which is fixed in the auditory canal by otoplasty. The hearing aid and, in particular, the signal processing device 3 are supplied with energy by a battery 5 which is likewise integrated in the hearing aid housing 1.

The signal processing device 3 according to the invention is also configured to process electromagnetic waves. For this purpose, it has an antenna device 20 and means 6 for generating and detecting electromagnetic waves and for decoding. The illustration with respect to the form and arrangement in FIG. 1 is only symbolic here and is explained in more detail with respect to the following figures.

Figure 2:
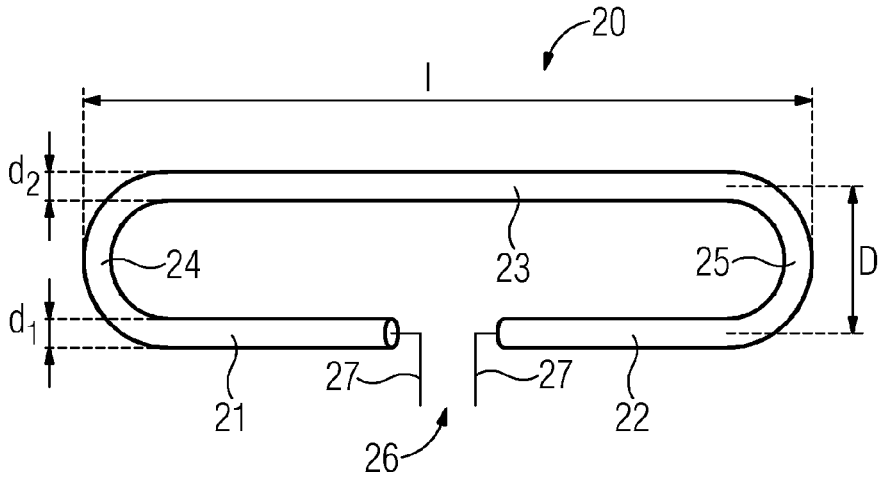
FIG. 2 is a schematic illustration of a folded dipole.

FIG. 2 shows a schematic illustration of a folded dipole which constitutes one possible embodiment of the antenna device 20 according to the invention. The antenna device has a first conductor 21 and a second conductor 22 which extend away from an energy coupling device 26 in opposite directions.

In the embodiment illustrated, the energy coupling device 26 is a simple ohmic connection of the first conductor 21 and the second conductor 22 to an electrical waveguide 27. On account of the symmetrical properties of the antenna device and on account of the characteristic impedance of 240 ohms for an ideal folded dipole at the base, that is to say the coupling point, a symmetrical strip line or strip transmission line with an identical characteristic impedance can be used here to ensure optimal adaptation. If the source or sink at the line 27 has a different characteristic impedance or asymmetry, adaptation is possible by suitable balancing elements, for example a balun.

In addition to the ohmic coupling illustrated, capacitive or inductive energy coupling devices, such as a transformer coil, are also conceivable as energy coupling devices.

The antenna device 20 also has a third conductor 23 which is arranged at a distance D from the first conductor 21 and the second conductor 22. The distance D is illustrated to be disproportionate to a length l of the folded dipole 20 here. The distance is preferably 0.05 times the wavelength of the electromagnetic wave to be emitted or received. Such a distance can be considered to be a short distance in the sense of the invention. However, it is also conceivable for a distance of one tenth of the wavelength to be considered to be a short distance D in the sense of the invention in the event of particular deviations of the form or length l from the value explained below, which distance can produce the desired properties such as a high impedance at the base.

At the ends of the first conductor 21 and the second conductor 22 which are distal from or opposite the energy coupling device 26, the conductors are connected to the third conductor 23 via a first ohmic connection 24 and a second ohmic connection 25. As illustrated, the connection can be effected by virtue of the first, second and third conductors being produced in one piece and merging into one another as ohmic connections 24, 25 as a result of a bend. However, it is also conceivable for the first, second and third conductors 21, 22, 23 to be ohmically separate conductors or conductor tracks which are subsequently connected to one another by an ohmic connection, for example a solder bridge. This makes it possible to subsequently determine and adapt the distance between the energy coupling device 26 and ohmic connections 24, 25.

The length l is ideally half the wavelength lambda of the electromagnetic wave for a folded dipole 20 in free space. As a result of the adjacent conductors, the carrier material of the conductors and the geometrical arrangement of the arms in space, the length l and the length of the arms, for which the folded dipole 20 satisfies the resonance condition for the frequency to be transmitted or received, may differ considerably from the value of lambda divided by two for the length l. The characteristic impedance at the base and/or minimal reflection of the electromagnetic wave at the energy coupling device 26 may be used as criteria for the resonance condition. The value for the overall length l may be in the range from lambda to lambda divided by four. In this case, the effective length l is lambda divided by two, the geometric length being able to be in the range from lambda to lambda divided by four, and the length of an arm being able to be in the range from lambda divided by two to lambda divided by eight. However, it is also conceivable to use other modes of the antenna and for the length to be respectively an integer multiple.

The energy coupling device 26 is arranged in the center between the first conductor 21 and the second conductor 22, with the result that, in the case of the ideal folded dipole 20, the distance between the energy coupling device 26 and the first ohmic connection 24 and the second ohmic connection 25 is a quarter of the wavelength lambda. A suitable length l may differ from this value as a result of a different distance D between the conductors, a different geometry in the arrangement differing from a planar, stretched form and the environment. It is therefore conceivable for the length l to differ from the ideal length by a tenth, a fifth or a quarter, the antenna device 20 nevertheless achieving the desired advantageous effects in the hearing aid device according to the invention. This may be the case, in particular, in the embodiment of an antenna device 20 shown in FIG. 4. In this embodiment, the antenna device has a further, fourth conductor 28 which is arranged at a short distance from the first conductor 21 and the second conductor 22 and the third conductor 23, a further ohmic connection being arranged between the first conductor and the fourth conductor and between the second conductor and the fourth conductor at the predetermined distance from the energy coupling device.

Derived from the principle illustrated in FIG. 2, further variants of folded dipoles are also suitable for use in hearing aid devices according to the invention. In addition to a variation in the length l, the base impedance may be changed by the width of the first, second and third conductors which run in a parallel manner. A further possible way of influencing the base impedance is to add further parallel arms. A folded dipole having three arms can be seen in FIG. 4. In this case, the energy coupling device may be arranged on one of the outer arms or on the middle arm.

The thicknesses of the first, second, third and fourth conductors 21, 22, 23, 28 and the distances between these conductors are generally different and are used as degrees of freedom during design. The integration of a three-armed folded dipole with identical thicknesses and distances in a hearing aid device is explained below with respect to FIG. 4. Further degrees of freedom result from the addition of further arms or else by an asymmetrical orientation of the antenna.

Figure 3:
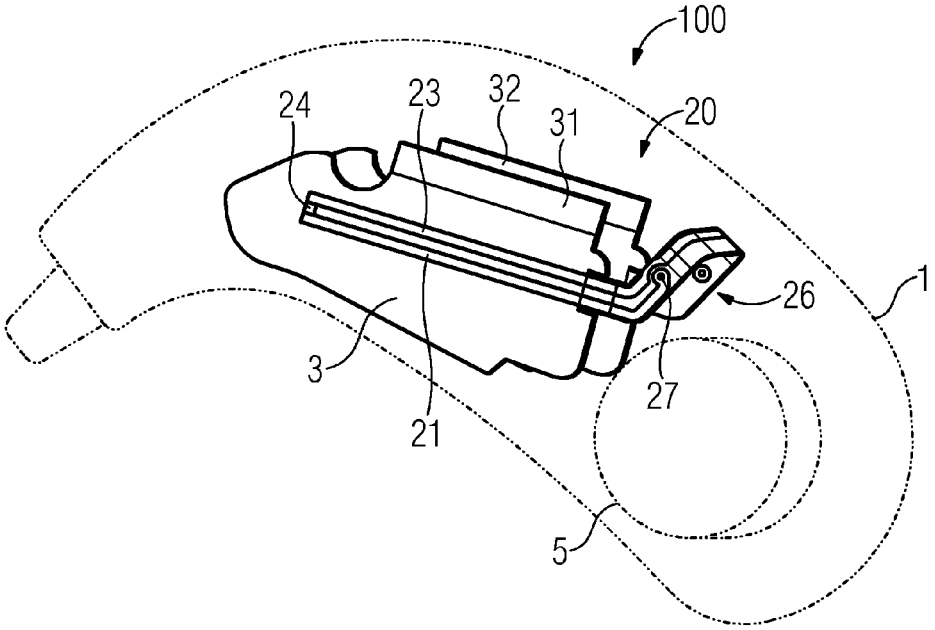
FIG. 3 is a diagrammatic, partial sectional view of the hearing aid device according to the invention.

FIG. 3 is an illustration of a hearing aid device according to the invention in partial section. A signal processing device 3 and an energy source 5 are arranged in a hearing aid device 100. The signal processing device 3 has a transceiver module 6 (not visible in FIG. 3) as the means for generating and detecting electromagnetic waves and for decoding. The transceiver module 6 is ohmically coupled to the first conductor 21 by the line 27. The first conductor 21 is connected, via the ohmic bridge 24, to the third conductor 23 which extends away from the energy coupling device 26 at a short distance from the first conductor 21.

A comparable arrangement for the second conductor 22 and the third conductor 23 is situated behind the signal processing device 3 and is not visible in FIG. 3.

The spatial arrangement in relation to the hearing aid 100 can also be gathered from FIG. 3. The signal processing device has two outer surfaces which are oriented substantially parallel to the outer walls of the housing 1 of the hearing aid device 100. The hearing aid device 100 illustrated is a behind-the-ear hearing aid device which, according to the use, is worn behind the outer ear (auricle) on the head of a person wearing the hearing aid device. In this case, the outer walls of the housing 1 rest against the side wall of the skull and the outer ear, with the result that both the outer wall of the housing 1 and the surfaces 31 and 32 of the signal processing device 3 are oriented substantially parallel to a plane of symmetry of the head of the person wearing the hearing aid device. In this case, substantially means that the plane of symmetry of the head and the surfaces 31, 32 of the signal processing device enclose an angle of less than 5 degrees or less than 10 degrees, for example.

As can be seen from FIG. 3, the first conductor 21 and that part of the third conductor 23 which runs parallel thereto are arranged parallel to the surface 31 of the signal processing device 3 and therefore parallel to the plane of symmetry of the head. The same applies to the second conductor 22 and to the part of the conductor 23 which are arranged on the surface 32 of the signal processing device 3. The arrangement containing the first conductor 21, the second conductor 22, the third conductor 23, the signal processing device 3 and the energy coupling device 26 is in turn per se symmetrical with respect to a plane which runs in the center between and parallel to the surfaces 31, 32 of the signal processing device 3. This internal symmetry and the arrangement of the hearing aid 100 in a plane parallel to the plane of symmetry of the head of the wearer in turn result in the fact that the hearing aid 100 can be advantageously optionally arranged on both ears of the person wearing the hearing aid device according to the use without the transmitting and receiving properties of the antenna device changing (apart from the reflection). A hearing aid 100 according to the invention can therefore equally be worn on the left ear and on the right ear.

In this case, it is conceivable for the first conductor 21 and the second conductor 22 and that part of the third conductor 23 which runs parallel thereto to be arranged only substantially in planes parallel to the plane of symmetry of the head but to follow, for example, a bend or a curvature of the surfaces 31, 32 of the signal processing device 3 without fundamentally leaving the orientation parallel to the plane of symmetry.

Figure 4:
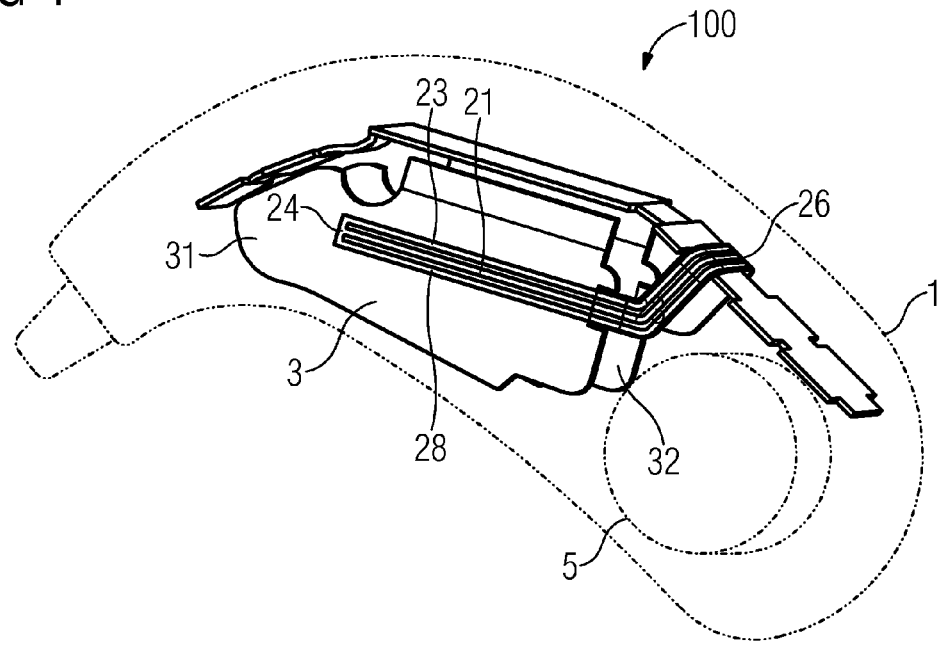
FIG. 4 is a partial sectional view of the hearing aid device according to the invention.

FIG. 4 shows a further embodiment of a hearing aid device 100 according to the invention. The same reference symbols here denote the same items as in FIG. 3.

The item in FIG. 4 differs from the item in FIG. 3 by virtue of a different embodiment of the antenna device 20. In addition to the first conductor 21, the second conductor 22 and the third conductor 23, the antenna device 20 has a fourth conductor 28 which is arranged parallel to the first conductor 21 and the second conductor 22 on a side of the conductors 21, 22 which is opposite the conductor 23. The distance between the first conductor 21 and the third conductor 23 is the same as the distance between the first conductor 21 and the fourth conductor 28. In another embodiment, however, the distances may be different as long as this distance is a short distance in the sense of the invention, as has already been explained.

The antenna apparatuses 20 may be implemented differently in different embodiments. The examples illustrated in FIG. 3 and FIG. 4 are based on the implementation of printed antennas with a flexible carrier substrate. In principle, implementation on a rigid substrate is also possible.

In addition, an antenna structure may be directly applied to the housing or the frame of the hearing aid. This may be the case, for example, if a laser-activated substrate (molded injection device, MID) is used. In this case, conductive elements, for example the first, second, third and fourth conductors 21, 22, 23, 28, are embedded in an injection molding material. However, it is also conceivable for a conductive film or layer to be applied to a frame or to an inner wall of a housing 1 and to then be structured in the form described. The film may be applied by deposition, spraying-on, vapor deposition, adhesive bonding or in another manner. Chemical methods such as etching and photolithography, mechanical methods such as milling or else physical methods such as evaporation with a laser can be used for structuring.

Although the invention has been described and illustrated more specifically in detail by means of the preferred exemplary embodiment, the invention is not restricted by the disclosed examples and other variations can be derived therefrom by a person skilled in the art without departing from the scope of protection of the invention.

The invention claimed is:

1. A hearing aid device, comprising:

a receiver, a signal processing device configured for being supplied with energy from a battery, and at least one microphone configured for providing a signal to said signal processing device, said signal processing device configured for processing the signal from said at least one microphone and for providing an output signal to said receiver;

an antenna device configured for at least one of receiving or emitting electromagnetic waves of a predetermined wavelength lambda, said antenna device forming a folded dipole, said antenna device including:

an energy coupling device configured to supply electrical energy to said antenna device or to draw the electrical energy from said antenna device, said energy coupling device coupled to said signal processing device;

conductors including a first conductor, a second conductor and a third conductor for exchanging energy with said energy coupling device, said first and second conductors connected to said energy coupling device, extending away from said energy coupling device in different directions and disposed at a distance of less than 0.05 times lambda from said third conductor;

a first ohmic connection connecting said first conductor to said third conductor; and a second ohmic connection connecting said second conductor to said third conductor, said first and second ohmic connections disposed at a given distance from said energy coupling device, the given distance having a length in a range between lambda divided by two and lambda divided by eight.

2. The hearing aid device according to claim 1, wherein said antenna device has a fourth conductor, said fourth conductor disposed at a further distance from said first conductor and said second conductor and/or said third conductor, an ohmic connection being disposed between said first conductor and said fourth conductor and between said second conductor and said fourth conductor at a predetermined distance from said energy coupling device.

3. The hearing aid device according to claim 1, wherein said antenna device has a plane of symmetry which runs through said energy coupling device.

4. The hearing aid device according to claim 1, wherein a plane of symmetry of said antenna device being oriented substantially parallel to a plane of symmetry of a head of a person wearing the hearing aid device when the hearing aid device is worn.

5. The hearing aid device according to claim 1, further comprising a structural element and said antenna device is part of said structural element.

6. The hearing aid device according to claim 5, wherein said first conductor, said second conductor and said third conductor are formed by structuring a conductive surface on said structural element.

7. The hearing aid device according to claim 1, further comprising a flexible carrier element, said antenna device is disposed on said flexible carrier element.

8. The hearing aid device according to claim 1, wherein said energy coupling device coupling to said antenna device via ohmic contacts.

9. The hearing aid device according to claim 1, wherein said energy coupling device coupling capacitively to said antenna device.

10. The hearing aid device according to claim 1, wherein said energy coupling device coupling inductively to said antenna device.

11. An antenna, comprising:

an antenna device configured for at least one of receiving or emitting electromagnetic waves of a predetermined wavelength lambda, said antenna device forming a folded dipole, said antenna device including:

an energy coupling device configured to supply electrical energy to said antenna device or to draw the electrical energy from said antenna device;

said energy coupling device configured to be coupled to a signal processing device for processing a signal from a microphone;

conductors including a first conductor, a second conductor and a third conductor for exchanging energy with said energy coupling device, said first and second conductors connected to said energy coupling device, extending away from said energy coupling device in different directions and disposed at a distance of less than 0.05 times lambda from said third conductor;

a first ohmic connection connecting said first conductor to said third conductor; and a second ohmic connection connecting said second conductor to said third conductor, said first and second ohmic connections disposed at a given distance from said energy coupling device, the given distance having a length in a range between lambda divided by two and lambda divided by eight.

12. The antenna according to claim 11, wherein said antenna device has a fourth conductor, said fourth conductor disposed at a further distance from said first conductor and said second conductor and/or said third conductor, an ohmic connection being disposed between said first conductor and said fourth conductor and between said second conductor and said fourth conductor at a predetermined distance from said energy coupling device.

13. The antenna according to claim 11, wherein said antenna device has a plane of symmetry which runs through said energy coupling device.

14. The antenna according to claim 11, wherein a plane of symmetry of said antenna device being oriented substantially parallel to a plane of symmetry of a head of a person wearing the hearing aid device when the hearing aid device is worn.

15. The antenna according to claim 11, further comprising a structural element and said antenna device is part of said structural element.

16. The hearing aid device according to claim 5, wherein said first conductor, said second conductor and said third conductor are formed by structuring a conductive surface on said structural element.

17. The antenna according to claim 11, further comprising a flexible carrier element, said antenna device is disposed on said flexible carrier element.

18. The antenna according to claim 11, wherein said energy coupling device coupling to said antenna device via ohmic contacts.

19. The antenna according to claim 11, wherein said energy coupling device coupling capacitively to said antenna device.

20. The antenna according to claim 11, wherein said energy coupling device coupling inductively to said antenna device.

* * * * *